US008678015B2

(12) United States Patent
Winterson et al.

(10) Patent No.: US 8,678,015 B2
(45) Date of Patent: Mar. 25, 2014

(54) NON-TOBACCO POUCH PRODUCT

(75) Inventors: Warren D. Winterson, Chester, VA (US); Timothy D. Cochran, Richmond, VA (US); Tommy C. Holland, Midlothian, VA (US); Karen M. Torrence, Chester, VA (US); Steve Rinehart, Chesterfield, VA (US); G. Robert Scott, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 13/097,853

(22) Filed: Apr. 29, 2011

(65) Prior Publication Data

US 2011/0203601 A1 Aug. 25, 2011

Related U.S. Application Data

(62) Division of application No. 11/413,053, filed on Apr. 28, 2006, now Pat. No. 7,950,399.

(60) Provisional application No. 60/675,900, filed on Apr. 29, 2005.

(51) Int. Cl.
*A24B 3/12* (2006.01)

(52) U.S. Cl.
USPC ..... 131/347; 131/352; 131/359; 131/369

(58) Field of Classification Search
None
See application file for complete search history.

(56) References Cited

U.S. PATENT DOCUMENTS

| | | | | |
|---|---|---|---|---|
| 307,537 | A | | 11/1884 | Foulks |
| 1,234,279 | A | | 7/1917 | Buchanan |
| 1,376,586 | A | | 5/1921 | Schwartz |
| 1,992,152 | A | | 2/1935 | yeates |
| 2,313,696 | A | | 3/1941 | Yates |
| 2,306,400 | A | | 12/1942 | Menzel |
| 2,318,101 | A | | 5/1943 | Rose |
| 2,528,778 | A | | 11/1950 | Piazze |
| 3,067,068 | A | | 12/1962 | Finberg |
| 3,162,199 | A | | 12/1964 | Moll, Jr. |
| 3,147,889 | A | | 3/1965 | Anderson et al. |
| 3,174,889 | A | * | 3/1965 | Anderson et al. ..... 156/254 |

(Continued)

FOREIGN PATENT DOCUMENTS

| | | |
|---|---|---|
| EP | 0212234 A2 | 7/1986 |
| EP | 0145499 | 4/1989 |

(Continued)

OTHER PUBLICATIONS

Satel, Sally, M.D., "A Smokeless Alternative to Quitting", Apr. 6, 2004, The New York Times, Accessed Oct. 25, 2010: http://query.nytimes.com/gst/fullpage.html?res=9402EFD91E39F935A35757C0A9629C8B63.

(Continued)

*Primary Examiner* — Michael J Felton
(74) *Attorney, Agent, or Firm* — Buchanan Ingersoll & Rooney PC

(57) ABSTRACT

A pouched non-tobacco product includes a lined pouch material of a web and a water-soluble liner adjacent the web and a non-tobacco flavorful component contained within the lined pouch material. The water-soluble liner is interposed between the web and the non-tobacco flavorful component. The liner preferably reduces staining of the web by the non-tobacco flavorful component. Additionally, the liner may include a flavorant.

18 Claims, 6 Drawing Sheets

(56) References Cited

U.S. PATENT DOCUMENTS

| | | | | |
|---|---|---|---|---|
| 3,188,265 | A | 6/1965 | Charbonneau et al. | |
| 3,369,551 | A | 2/1968 | Carroll | |
| 3,415,286 | A | 12/1968 | Arnold et al. | |
| 3,600,807 | A | 8/1971 | Sipos | |
| 3,607,299 | A | 9/1971 | Bolt | |
| 3,692,536 | A | 9/1972 | Fant | |
| 3,757,798 | A * | 9/1973 | Lambert | 131/270 |
| 3,846,569 | A | 11/1974 | Kaplan | |
| 3,932,192 | A | 1/1976 | Nakashio et al. | |
| 4,218,286 | A | 8/1980 | Jones et al. | |
| 4,347,857 | A | 9/1982 | Boden | |
| 4,545,392 | A | 10/1985 | Sensabaugh et al. | |
| 4,565,702 | A | 1/1986 | Morley et al. | |
| 4,607,479 | A | 8/1986 | Linden | |
| 4,624,269 | A | 11/1986 | Story et al. | |
| 4,660,577 | A | 4/1987 | Sensabaugh et al. | |
| 4,703,765 | A | 11/1987 | Paules et al. | |
| 4,797,287 | A | 1/1989 | Pich et al. | |
| 4,880,697 | A | 11/1989 | Caldwell et al. | |
| 4,892,483 | A | 1/1990 | Douglas, Jr. | |
| 4,907,605 | A | 3/1990 | Ray | |
| 4,917,161 | A | 4/1990 | Townend | |
| 5,127,208 | A | 7/1992 | Custer et al. | |
| 5,167,244 | A | 12/1992 | Kjerstad | |
| 5,174,088 | A | 12/1992 | Focke et al. | |
| 5,186,185 | A | 2/1993 | Mashiko et al. | |
| 5,211,985 | A | 5/1993 | Shirley, Jr. et al. | |
| 5,240,016 | A | 8/1993 | Nichols et al. | |
| 5,263,999 | A | 11/1993 | Baldwin et al. | |
| 5,346,734 | A | 9/1994 | Wydick, Jr. | |
| 5,372,149 | A | 12/1994 | Roth et al. | |
| 5,387,416 | A | 2/1995 | White et al. | |
| 5,525,351 | A | 6/1996 | Dam | |
| 5,549,906 | A | 8/1996 | Santus | |
| 5,601,716 | A | 2/1997 | Heinrich et al. | |
| 5,726,161 | A | 3/1998 | Whistler | |
| 5,773,062 | A | 6/1998 | Cirigliano et al. | |
| 5,806,408 | A | 9/1998 | DeBacker et al. | |
| 5,829,453 | A | 11/1998 | White et al. | |
| 5,921,955 | A | 7/1999 | Mazer et al. | |
| 5,927,052 | A | 7/1999 | Nippes et al. | |
| 5,997,691 | A | 12/1999 | Gautam et al. | |
| 6,135,120 | A | 10/2000 | Löfman et al. | |
| 6,143,316 | A | 11/2000 | Hayden et al. | |
| 6,146,655 | A | 11/2000 | Ruben | |
| 6,162,516 | A | 12/2000 | Derr | |
| 6,280,761 | B1 | 8/2001 | Santus | |
| 6,287,612 | B1 | 9/2001 | Mandava et al. | |
| 6,325,859 | B1 | 12/2001 | De Roos et al. | |
| 6,383,475 | B1 | 5/2002 | Meyers et al. | |
| 6,414,033 | B1 | 7/2002 | Sceusa | |
| 6,444,253 | B1 | 9/2002 | Conklin et al. | |
| 6,455,068 | B1 | 9/2002 | Licari | |
| D489,606 | S | 5/2004 | Lofman | |
| 6,871,473 | B1 | 3/2005 | Dutt et al. | |
| 6,895,974 | B2 | 5/2005 | Peele | |
| 6,942,848 | B2 | 9/2005 | Nelson et al. | |
| 6,958,429 | B2 | 10/2005 | Bruhn et al. | |
| 6,982,093 | B2 | 1/2006 | Licari | |
| 6,984,376 | B2 | 1/2006 | Stephenson et al. | |
| 7,030,092 | B1 | 4/2006 | Levine | |
| 7,032,601 | B2 | 4/2006 | Atchley et al. | |
| 7,090,858 | B2 | 8/2006 | Jayaraman | |
| 7,186,701 | B2 | 3/2007 | Kubota et al. | |
| D568,576 | S | 5/2008 | Neidle et al. | |
| D585,626 | S | 2/2009 | Chappell, Sr. et al. | |
| 7,584,843 | B2 | 9/2009 | Kutsch et al. | |
| 7,950,399 | B2 | 5/2011 | Winterson et al. | |
| 2002/0012689 | A1 | 1/2002 | Stillman | |
| 2002/0170567 | A1 | 11/2002 | Rizzotto et al. | |
| 2003/0070687 | A1 | 4/2003 | Atchley et al. | |
| 2003/0109492 | A1 | 6/2003 | Loftsson | |
| 2003/0224090 | A1 | 12/2003 | Pearce et al. | |
| 2004/0015756 | A1 | 1/2004 | Chiu et al. | |
| 2004/0018293 | A1 | 1/2004 | Popplewell et al. | |
| 2004/0037879 | A1 | 2/2004 | Adusumilli et al. | |
| 2004/0118421 | A1 | 6/2004 | Hodin et al. | |
| 2004/0123873 | A1 | 7/2004 | Calandro et al. | |
| 2004/0145261 | A1 | 7/2004 | Ganter et al. | |
| 2004/0191322 | A1 | 9/2004 | Hansson | |
| 2004/0191366 | A1 | 9/2004 | Mangos et al. | |
| 2004/0202698 | A1 | 10/2004 | Ramji et al. | |
| 2004/0234479 | A1 | 11/2004 | Schleifenbaum et al. | |
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0000531 | A1 | 1/2005 | Shi | |
| 2005/0003048 | A1 | 1/2005 | Pearce et al. | |
| 2005/0034738 | A1 | 2/2005 | Whalen | |
| 2005/0061339 | A1 | 3/2005 | Hansson et al. | |
| 2005/0100640 | A1 | 5/2005 | Pearce | |
| 2005/0172976 | A1 | 8/2005 | Newman et al. | |
| 2005/0178398 | A1 | 8/2005 | Breslin et al. | |
| 2005/0210615 | A1 | 9/2005 | Shastry et al. | |
| 2005/0241656 | A1 | 11/2005 | Kennison | |
| 2005/0244521 | A1 | 11/2005 | Strickland et al. | |
| 2005/0287249 | A1 | 12/2005 | Shukla et al. | |
| 2006/0039973 | A1 | 2/2006 | Aldritt et al. | |
| 2006/0073190 | A1 | 4/2006 | Carroll et al. | |
| 2006/0118589 | A1 | 6/2006 | Arnarp et al. | |
| 2006/0144412 | A1 | 7/2006 | Mishra et al. | |
| 2006/0174901 | A1 | 8/2006 | Karles et al. | |
| 2006/0191548 | A1 | 8/2006 | Strickland et al. | |
| 2006/0204598 | A1 | 9/2006 | Thompson | |
| 2006/0228431 | A1 | 10/2006 | Eben et al. | |
| 2006/0275344 | A1 | 12/2006 | Mody et al. | |
| 2007/0000505 | A1 | 1/2007 | Zhuang et al. | |
| 2007/0012328 | A1 | 1/2007 | Winterson et al. | |
| 2007/0048431 | A1 | 3/2007 | Budwig et al. | |
| 2007/0062549 | A1 | 3/2007 | Holton, Jr. et al. | |
| 2007/0077307 | A1 | 4/2007 | Rosenberg et al. | |
| 2007/0095356 | A1 | 5/2007 | Winterson et al. | |
| 2007/0107747 | A1 | 5/2007 | Hill et al. | |
| 2007/0122526 | A1 | 5/2007 | Sweeney et al. | |
| 2007/0186941 | A1 | 8/2007 | Holton, Jr. et al. | |
| 2007/0186942 | A1 | 8/2007 | Strickland et al. | |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2007/0207239 | A1 | 9/2007 | Neidle et al. | |
| 2007/0261707 | A1 | 11/2007 | Winterson et al. | |
| 2007/0267033 | A1 | 11/2007 | Mishra et al. | |
| 2007/0298061 | A1 | 12/2007 | Boghani et al. | |
| 2008/0014303 | A1 | 1/2008 | Jacops et al. | |
| 2008/0029110 | A1 | 2/2008 | Dube et al. | |
| 2008/0081071 | A1 | 4/2008 | Sanghvi et al. | |
| 2008/0196730 | A1 | 8/2008 | Engstrom et al. | |
| 2008/0202536 | A1 | 8/2008 | Torrence et al. | |
| 2008/0302682 | A1 | 12/2008 | Engstrom et al. | |
| 2008/0308115 | A1 | 12/2008 | Zimmermann et al. | |
| 2008/0317911 | A1 | 12/2008 | Schleef et al. | |
| 2009/0004329 | A1 | 1/2009 | Gedevanishvili et al. | |
| 2009/0022856 | A1 | 1/2009 | Cheng et al. | |
| 2009/0022917 | A1 | 1/2009 | Gedevanishvili et al. | |
| 2009/0025740 | A1 | 1/2009 | Chappell, Sr. et al. | |
| 2009/0025741 | A1 | 1/2009 | Crawford et al. | |
| 2009/0035414 | A1 | 2/2009 | Cheng et al. | |
| 2009/0126746 | A1 | 5/2009 | Strickland et al. | |
| 2010/0218779 | A1 | 9/2010 | Zhuang et al. | |
| 2010/0300464 | A1 | 12/2010 | Gee et al. | |
| 2010/0300465 | A1 | 12/2010 | Zimmermann | |
| 2011/0083680 | A1 | 4/2011 | Mishra et al. | |
| 2011/0180087 | A1 | 7/2011 | Gee et al. | |
| 2011/0236442 | A1 | 9/2011 | Miser et al. | |

FOREIGN PATENT DOCUMENTS

| | | |
|---|---|---|
| EP | 0352107 A2 | 1/1990 |
| EP | 0483500 A1 | 5/1992 |
| EP | 0422 898 | 9/1994 |
| EP | 0599 425 | 10/1997 |
| EP | 1010639 A1 | 6/2000 |
| EP | 1118274 A | 7/2001 |
| GB | 725764 | 3/1955 |

(56) References Cited

FOREIGN PATENT DOCUMENTS

| | | | |
|---|---|---|---|
| GB | 924052 | | 4/1963 |
| GB | 1139684 | | 1/1969 |
| GB | 1350740 | A | 4/1974 |
| GB | 2074838 | A | 11/1981 |
| JP | 03-240665 | | 10/1991 |
| WO | WO 94/25356 | A | 11/1994 |
| WO | WO 97/45336 | | 12/1997 |
| WO | WO 99/40799 | | 8/1999 |
| WO | WO 00/57713 | A1 | 10/2000 |
| WO | WO 01/70591 | A1 | 9/2001 |
| WO | WO 02/080707 | A1 | 10/2002 |
| WO | WO 03/028492 | A1 | 4/2003 |
| WO | WO 03/030881 | A1 | 4/2003 |
| WO | WO 03/053175 | A2 | 7/2003 |
| WO | WO 2004/009445 | A2 | 1/2004 |
| WO | WO 2004/052335 | A1 | 6/2004 |
| WO | WO 2004/056219 | A1 | 7/2004 |
| WO | WO 2004/058217 | A2 | 7/2004 |
| WO | WO 2004/064811 | A1 | 8/2004 |
| WO | WO 2004/066986 | A1 | 8/2004 |
| WO | WO 2004/095959 | A1 | 11/2004 |
| WO | WO 2005/027815 | | 3/2005 |
| WO | WO 2005/046363 | A | 5/2005 |
| WO | WO 2005/077232 | | 8/2005 |
| WO | WO 2005/084446 | | 9/2005 |
| WO | WO 2006/004480 | | 1/2006 |
| WO | WO 2006/039487 | A | 4/2006 |
| WO | WO 2006/065192 | | 6/2006 |
| WO | WO 2006/090290 | A | 8/2006 |
| WO | WO 2006/105173 | | 10/2006 |
| WO | WO 2006/120570 | A2 | 11/2006 |
| WO | WO 2006/127772 | A | 11/2006 |
| WO | WO 2007/037962 | A | 4/2007 |
| WO | WO 2007/057789 | A2 | 5/2007 |
| WO | WO 2007/057791 | A2 | 5/2007 |
| WO | WO 2007/082599 | A1 | 7/2007 |
| WO | WO 2007/104573 | | 9/2007 |
| WO | WO 2007/126361 | A1 | 11/2007 |
| WO | WO 2008/016520 | A2 | 2/2008 |
| WO | WO 2008/042331 | A2 | 4/2008 |
| WO | WO 2008/104891 | A2 | 9/2008 |
| WO | WO 2008/140372 | A1 | 11/2008 |

OTHER PUBLICATIONS

International Search Report and Written Opinion dated Aug. 6, 2007 for PCT/IB2006/004077.
International Search Report and Written Opinion dated Sep. 12, 2008 for PCT/IB2008/001378.
International Search Report and Written Opinion mailed Mar. 24, 2009 for PCT/IB2008/002764.
International Preliminary Report on Patentability issued Jan. 19, 2010 for PCT/IB2008/002764.
International Search Report and Written Opinion mailed Jul. 17, 2009 for PCT/IB2008/002714.
International Preliminary Report on Patentability issued Jan. 19, 2010 for PCT/IB2008/002714.
International Search Report and Written Opinion dated Jan. 30, 2009 for PCT/IB2008/002598.
International Search Report and Written Opinion mailed Feb. 25, 2009 for PCT/IB2008/002566.
International Preliminary Report on Patentability issued Dec. 11, 2009 for PCT/IB2008/002598.
International Search Report and Written Opinion mailed Mar. 25, 2009 for PCT/IB2008/002682.
International Preliminary Report on Patentability issued Jan. 19, 2010 for PCT/IB2008/002682.
International Search Report and Written Opinion mailed Mar. 31, 2009 for PCT/IB2008/002681.
International Search Report and Written Opinion mailed Jul. 25, 2006 for PCT/IB2006/001114.
International Preliminary Report on Patentability dated Aug. 28, 2007 for PCT/IB2006/001114.
International Search Report and Written Opinion mailed Mar. 13, 2009 for PCT/IB2008/002694.
International Preliminary Report on Patentability issued Jan. 19, 2010 for PCT/IB2008/002694.
Partial International Search Report dated Oct. 6, 2006 for PCT/IB2006/001611.
International Search Report and Written Opinion dated Feb. 27, 2007 for PCT/IB2006/002680.
International Preliminary Report on Patentability dated Oct. 30, 2007 for PCT/IB2006/001611.
International Preliminary Report on Patentability mailed Dec. 16, 2008 for PCT/IB2006/0022680.

* cited by examiner

NON-TOBACCO POUCH PRODUCT

This application is a divisional of U.S. patent application Ser. No. 11/413,053, entitled NON-TOBACCO POUCH PRODUCT, filed on Apr. 28, 2006 now U.S. Pat. No. 7,950,399, which claims priority under 35 U.S.C. §119(e) to U.S. Provisional Application No. 60/675,900, filed on Apr. 29, 2005, the entire content of each is incorporated herein by reference.

BACKGROUND

Pouched tobacco products offer an individual portion of tobacco that is to be placed under the upper lip. A problem with commercially available pouched tobacco products is that moisture emitted from the tobacco material may carry tobacco and tobacco additives that stain or discolor the pouch containing the tobacco material.

SUMMARY

Provided is a pouched non-tobacco product comprising a lined pouch material and a non-tobacco flavorful component contained within the lined pouch material. The lined pouch material comprises a web and a water-soluble liner adjacent the web. The water-soluble liner is interposed between the web and the non-tobacco flavorful component.

Also provided is a method of making a pouched non-tobacco product comprising disposing a liner along a web and enclosing a non-tobacco flavorful component with the web and liner such that the liner is interposed between the non-tobacco flavorful component and the web.

Also provided is a lined pouch material of a pouched non-tobacco product comprising a web and a film or layer of liner adjacent the web. The film or layer optionally comprises a water-soluble flavorant.

Also provided is a pouched non-tobacco product comprising a lined pouch material and a non-tobacco flavorful component contained within the lined pouch material. The lined pouch material comprises a web and a liner adjacent the web. The liner is interposed between the web and the non-tobacco flavorful component. The pouched non-tobacco product comprises a longitudinal seam essentially free of the liner, the longitudinal seam constructed from overlapping longitudinal edge portions of the web, which are essentially in web-to-web contact with one another.

Also provided is a pouched non-tobacco product comprising a lined pouch material and a non-tobacco flavorful component contained within the lined pouch material. The lined pouch material comprises a web and a liner adjacent the web. The liner is interposed between the web and the non-tobacco flavorful component. The pouched non-tobacco product comprises at least one transverse seam essentially free of the liner, the at least one transverse seam constructed from overlapping transverse portions of the web, which are essentially in web-to-web contact with one another.

BRIEF DESCRIPTION OF THE DRAWING FIGURES

Figure 6A:
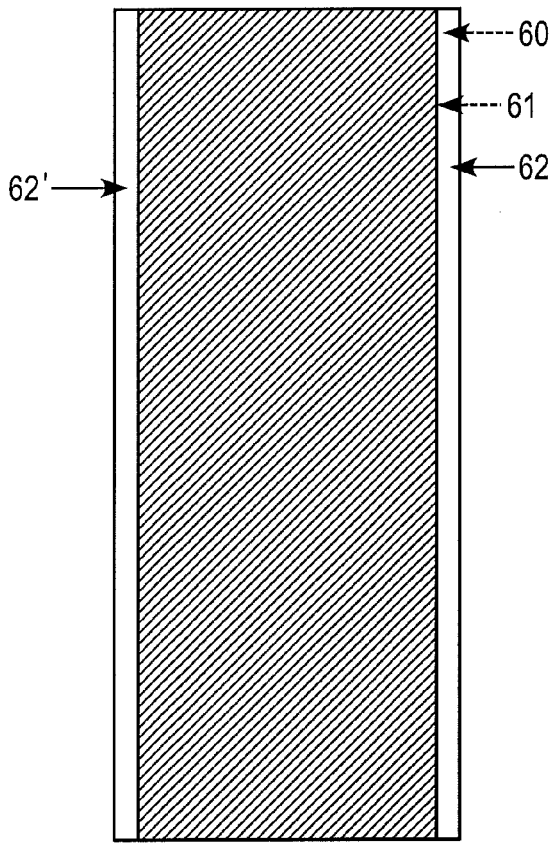

FIG. 6*a* is a planar view of a lined pouch material in an unfolded condition, wherein a liner has been continuously applied to a web.

Figure 6B:
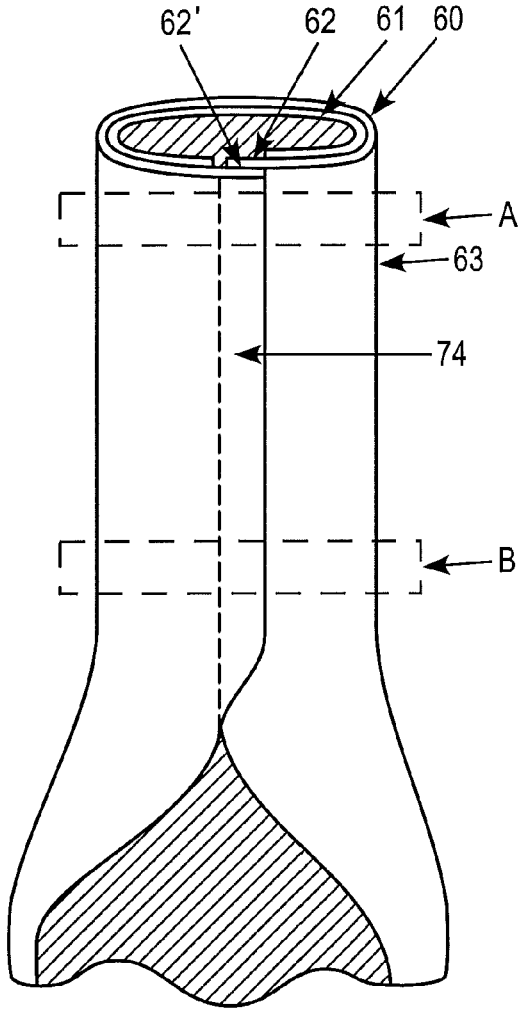

FIG. 6*b* is a perspective view of the lined pouch material of FIG. 6*a* in a condition of being rolled into a tubular formation.

Figure 7A:
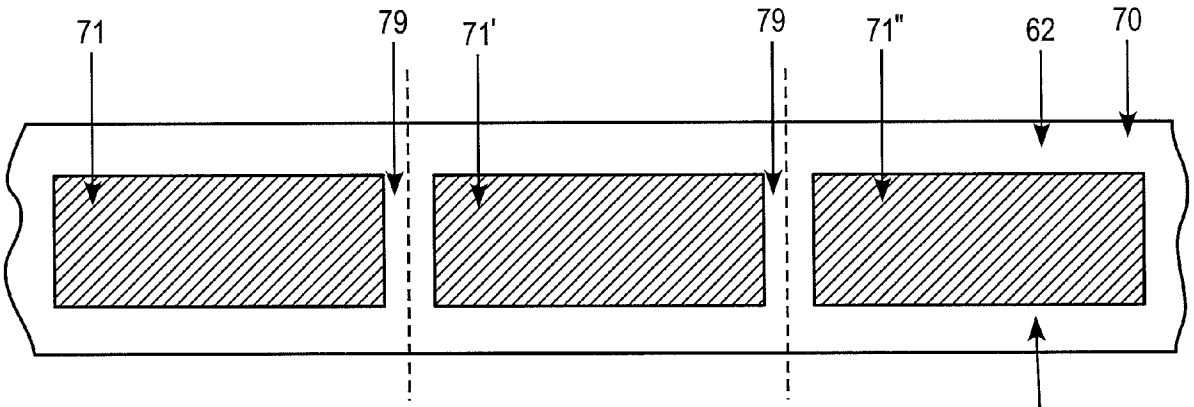

FIG. 7*a* illustrates an embodiment wherein liner has been intermittently applied to a web.

Figure 7B:
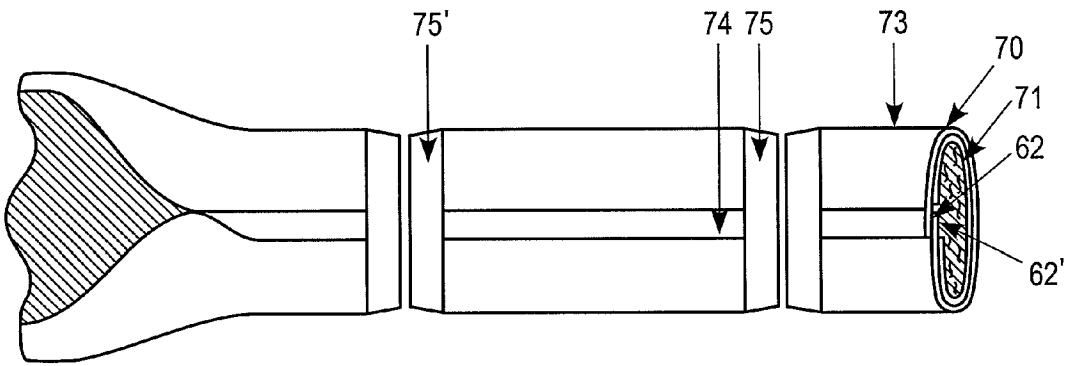

FIG. 7*b* illustrates formation of pouched non-tobacco products from the lined web of FIG. 7*a*.

Figure 8:
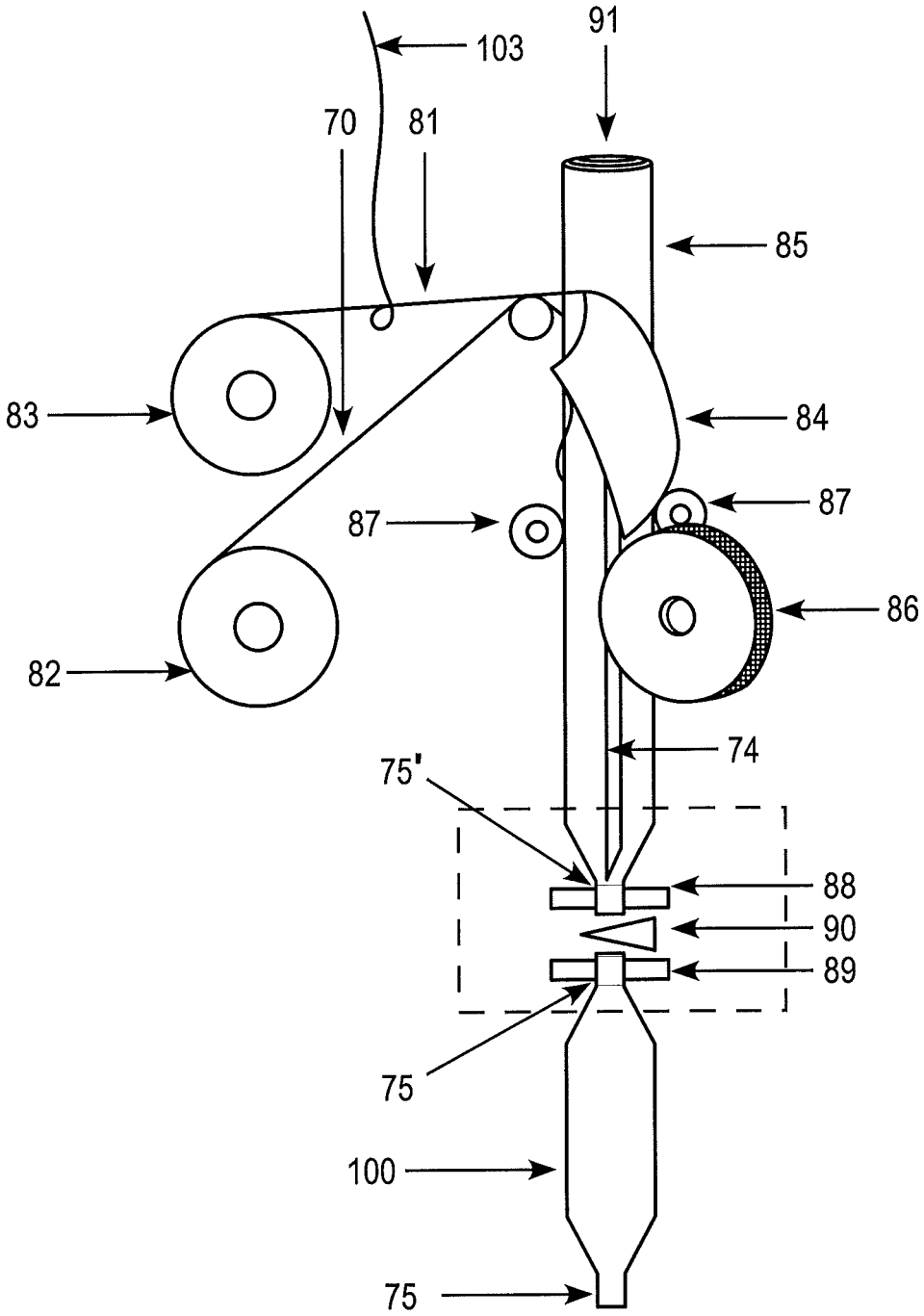

FIG. 8 illustrates exemplary equipment for formation of pouched non-tobacco products.

Figure 9:
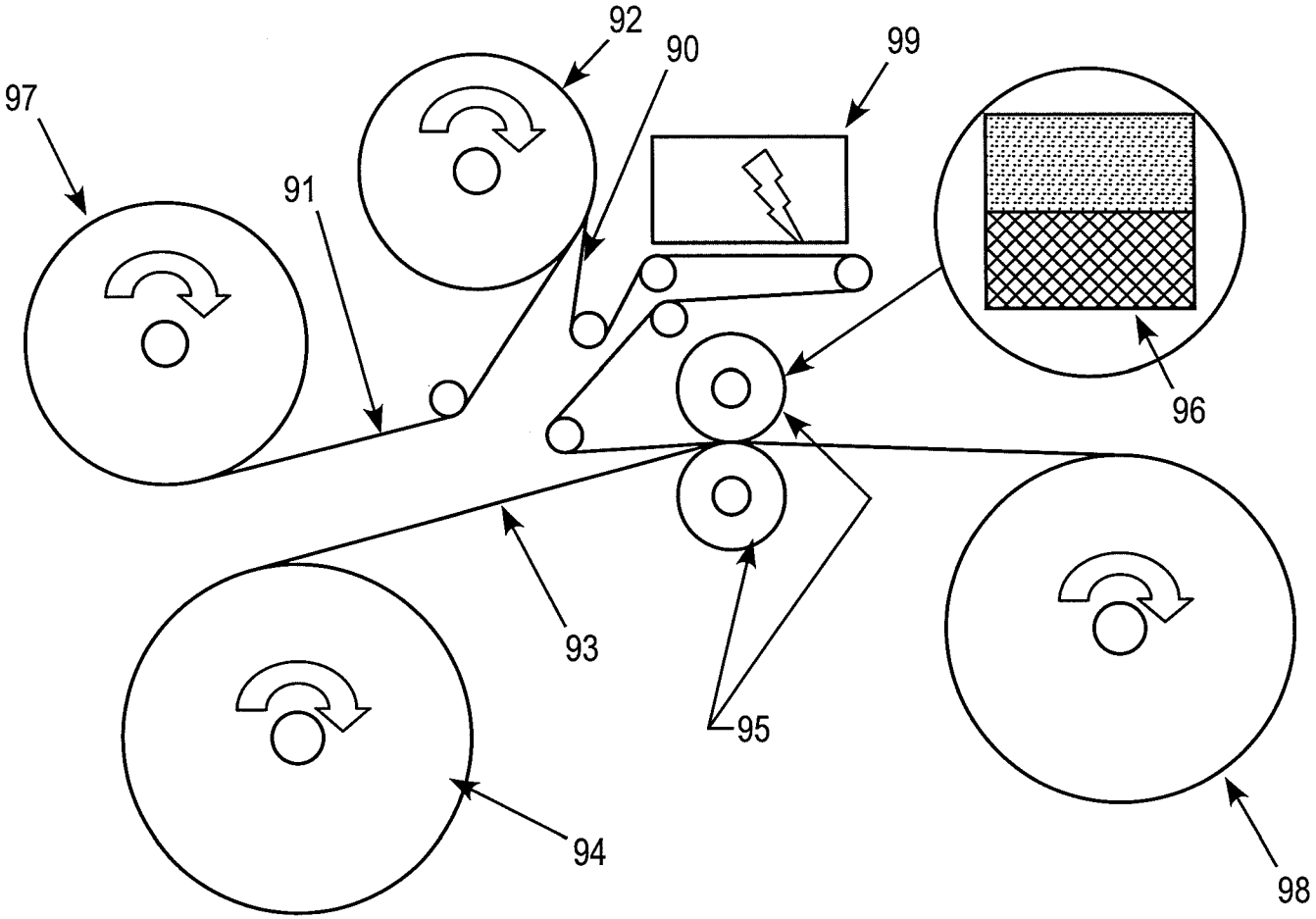

FIG. 9 illustrates exemplary equipment for production of a laminated lined pouch material.

DETAILED DESCRIPTION

Figure 1:
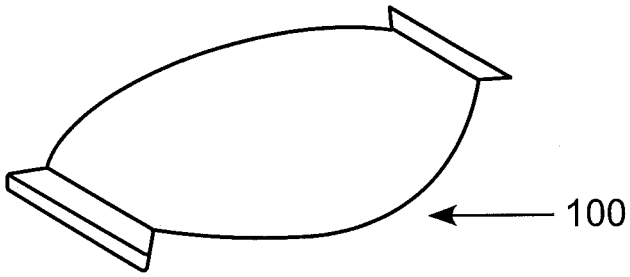
FIG. 1 illustrates a pouched non-tobacco product.
Figure 2:
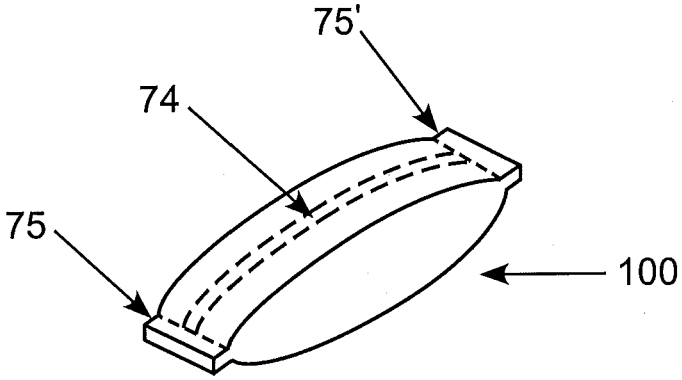
FIG. 2 illustrates a pouched non-tobacco product having seams as described in further detail below.
Figure 3:
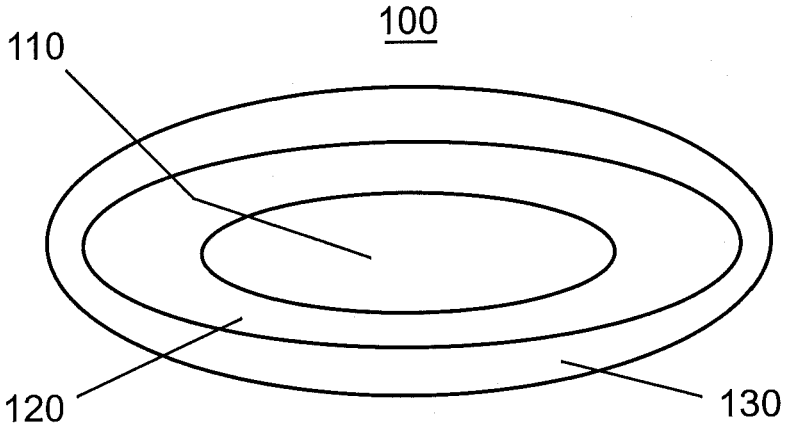
FIG. 3 illustrates a cross-sectional view of an embodiment of a pouched non-tobacco product including a liner.

FIG. 1 illustrates a pouched non-tobacco product 100, while FIG. 2 illustrates a pouched non-tobacco product having a longitudinal seam 74 and transverse seams 75, 75' as described in further detail below. With reference to FIG. 3, a pouched non-tobacco product 100 has a liner 120 disposed between a portion of non-tobacco flavorful material 110 and a web 130. The liner 120 reduces the tendency of the non-tobacco flavorful material 110 to discolor (stain) the web 130 and/or it releases flavor during use of the pouched non-tobacco product. The liner 120 reduces staining of the web 130 by reducing the opportunity for moisture from the non-tobacco flavorful material or its additives to reach the web 130 prior to use. It also allows the moisture content and other constituents of the non-tobacco flavorful material 110 to be maintained in its original (fresh) condition until use. Additionally, or alternatively, as mentioned above, the liner 120 can be provided to flavor the pouched non-tobacco product by including flavorants within the liner 120.

1. Non-Tobacco Material

The non-tobacco flavorful material can include vegetable or plant fibers or particles such as particles or shreds of lettuce, cotton, flax, beet fiber, cellulosic fibers, blends thereof and the like. Thus, a non-tobacco pouch product may be formed by establishing a non-tobacco flavorful component of natural and/or synthetic constituents comprising, for example, particles, shreds and/or fibers of flavorful plants or vegetables but without any tobacco. Examples of suitable non-tobacco flavorful components include the non-tobacco pouch ingredients disclosed in U.S. Provisional Application 60/738,034, the subject matter of which is hereby incorporated by reference. The flavorant itself may be selected from the group consisting of, tea, rose hips, honey, royal jelly, fruit extracts, vitamins, coffee, fruits, mint, vegetables, sweeteners, international flavors, exotic flavors, and ethnic flavors. Other flavors are also within the contemplation of this disclosure, whether natural, synthetic, or a combination of natural and synthetic. Moreover, flavors can be combined as may be desired, e.g., coffee-mint, pomegranate-kiwi Suitable flavors and aromas include, but are not limited to, any natural or synthetic flavor or aroma, such as menthol, mint (such as peppermint and spearmint), chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, and ginger oil. Other suitable flavors and aromas may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Humectants can also be added to the non-tobacco flavorful material 110 to help maintain the moisture levels in the pouched non-tobacco product. Examples of humectants that can be used with the non-tobacco material include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier non-tobacco flavor component.

2. Lined Pouch Material: Web

Preferably, the pouched non-tobacco product 100 includes lined pouched material comprising a web 130 and a liner 120. Preferably, the web 130 is constructed from cellulose fiber such as tea bag material. Alternative web materials may also be desired for use with the liners 120. Alternative web materials preferably have a neutral or pleasant taste or aroma. Preferably, the web material is selected to have desired properties of stain resistance, water permeability and/or porosity, and/or water insolubility. To promote heat-sealability the web may include fibers or coating of polypropylene or other heat-sealable material.

Additionally, the materials used for the web materials can be provided with predetermined levels for basis weight and/or wet strength in order to reduce occurrence of breakage of the web during manufacturing operations, storage and use. For example, webs can be provided with a basis weight of about 5 to about 25 g/m$^2$, such as 5-10, 10-15, 15-20, or 20-25 grams/meters$^2$ (g/m$^2$) depending upon the final usage requirements, and/or a wet tensile cross-direction (CD) strength of about 15 to about 75 N/m, such as 15-30, 30-45, 45-60, or 60-75 Newtons/meter (N/m) depending upon the final usage requirements, which can be sufficient for maintaining the webs therein. One exemplary web is a tea bag material with a basis weight of about 16.5 g/m$^2$ with a wet tensile CD strength of 68 N/m.

In an embodiment, a water permeable, water-insoluble, porous, stain-resistant polymer membrane can be used as the web in order to allow flavor from a liner 120 and/or from the non-tobacco flavorful material 110 to permeate through the web 130.

It is also noted that the thickness of the web 130 can be varied to achieve desired levels of solubility through the web 130. Similarly, the thickness of the liner 120 can be varied to achieve desired levels of solubility through the liner 120.

3. Lined Pouch Material: Liner Material

Figure 4:
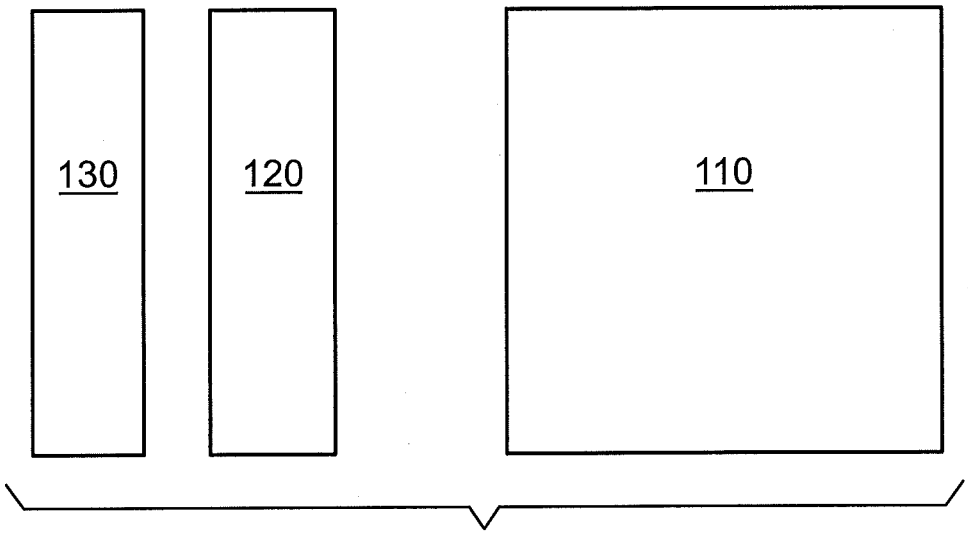
FIG. 4 illustrates a magnified cross-sectional view of an embodiment of a pouched non-tobacco product including a liner.

Referring to FIGS. 3 and 4, according to an embodiment, a liner 120 is provided in a pouched non-tobacco product 100 in between the non-tobacco flavorful material 110 and the web 130. As used herein the terms "liner" and "liner material" include one or more material sheets, layers or coatings, which can be used to carry flavorants (flavor enhancers) and/or reduce transfer of moisture from the non-tobacco flavorful component 110 to the web material 130, and/or reduce staining of the web material 130.

In the embodiments, the liner 120 is incorporated as a separate sheet, layer or coating on the inside of the web 130 facing the non-tobacco flavorful material. As such, the liner 120 can be a thin film sheet, layer or coating of only a few microns in thickness or can be a thicker sheet, layer or coating up to about 1 centimeter in thickness.

Preferably, the liner 120 is dissolved upon placement of the pouched non-tobacco product into the mouth although in some embodiments the liner 120 only partially dissolves. Preferably, the pouched non-tobacco product 100 provides an immediate and continued oral sensorial enjoyment of non-tobacco flavor by a consumer of the pouched non-tobacco product 110.

Preferably, the liner 120 is not soluble in additives of the non-tobacco flavorful material 110 so that the additives may be added to the non-tobacco flavorful material without causing the liner 120 to be dissolved. By such arrangement the effectiveness of the liner 120 against staining of the web is maintained.

The liner 120 can also be made semi water-soluble in order to provide a slower rate of dissolution of the liner 120 when placed in a mouth, if desired. For example, the liner 120 itself can be used to augment or be the carrier of a flavorant or flavor enhancer, wherein the liner 120 can provide rapid flavor release (i.e., high water solubility) or a time sustained flavor release (i.e., low water solubility compared to the rapid flavor release liner). The liner 120 can also include both highly soluble flavor ingredients and less soluble flavor ingredients. Thus, by using a liner 120 with predetermined level water solubility, a pouched non-tobacco product can be provided with rapid or time sustained flavor release and minimum staining of the web.

While the liner 120 can be used in an unflavored state, a flavorant can be incorporated in the liner 120, as mentioned above. When a flavorant is incorporated into the liner 120, the liner 120 can be chosen to provide rapid flavor release (i.e., immediate or a few seconds) or provide a long lasting, time-release flavor (i.e., prolonged up to several minutes and having the property of retarded or gradual dissolution in water to produce a sustained effect), as mentioned above or both.

In order to provide a rapid flavor release, a highly water-soluble liner can be used. By employing a highly water-soluble material in a pouched non-tobacco product, saliva can rapidly dissolve the liner 120 and rapidly release the flavor therein, thus providing flavor and a mouth feel at lower moisture levels similar to higher moisture content pouched non-tobacco products. Additionally, other materials can be used to retard the rapid dissolution of the liner 120. For example, additives, such as corn zein, can be added to a glucan liner to adjust (i.e., reduce) the water solubility of the glucan and thus retard or slow the dissolution speed of the glucan in water.

While any water-soluble material, such as cellulosic materials, gums, polymers, starches, proteins, and combinations thereof can be used, preferably the liner 120 is made of glucans because of their high water solubility, rapid dissolution, and pleasing mouth feel.

Examples of glucans include, without limitation, pullulan and elsinan.

Examples of cellulosic materials include, without limitation, carboxymethyl cellulose, methyl cellulose, ethyl cellulose, hydroxymethyl cellulose, hydroxyethyl cellulose, hydroxypropyl cellulose, hydroxypropylmethyl cellulose, hydroxymethylpropyl cellulose, and combinations thereof.

Examples of water-soluble gums include, without limitation, gum arabic, xanthan gum, tragacanth, acacia, carageenan, guar gum, locust bean gum, pectin, alginates, and combinations thereof.

Examples of other polymers include, without limitation, polyvinyl alcohol, polyacrylic acid, polyvinyl pyrrolidone, poly(meth)acrylate, poly(meth)copolymers, dextrin, dextran, chitin, chitosin, polydextrose, fructose, and combinations thereof.

Examples of starches include, without limitation, tapioca, rice, corn, potato, wheat, and combinations thereof.

Examples of proteins include gelatin, zein, gluten, soy protein, soy protein isolate, whey protein, whey protein isolate, casein, levin, collagen, and combinations thereof.

If a longer flavor release by the liner 120 is desired, a liner other than the rapidly dissolving liners discussed above may be selected. Or in the alternative, a thicker layer of liner can be used to extend the length of time for full dissolution of the liner and the associated release of flavorants. Or, as another alternative, longer organic chain materials or other agents can be added to the rapidly dissolving liners discussed above to lower solubility. Thus, the water solubility of the liner 120 can be increased or decreased and can provide control over the moisture content in the non-tobacco flavorful material 110 in the pouched non-tobacco product 100 by reducing the amount of moisture loss or evaporation from the non-tobacco flavorful material 110 in comparison to a pouched non-tobacco product without a liner.

For example, a highly water-soluble liner, such as a polysaccharide, can be provided with menthol flavor therein, wherein the flavor can be rapidly released from the liner upon contact of the liner with water or saliva. Thus, in addition to reducing staining of the web 130, the liner 120 can also enhance and/or supplement the flavor of the non-tobacco flavorful material in the pouched non-tobacco product 100.

Alternatively, a multilayered liner can be provided between a non-tobacco flavorful material 110 and a web 130. By providing a multilayered liner, the functionality of the liner can be enhanced compared to that of a single layer liner. For example, more than one level of water solubility can be used within the various layers of the multilayered liner if desired. The multilayered liner can include two, three, four, or more layers depending upon the properties desired from the liner.

Figure 5:
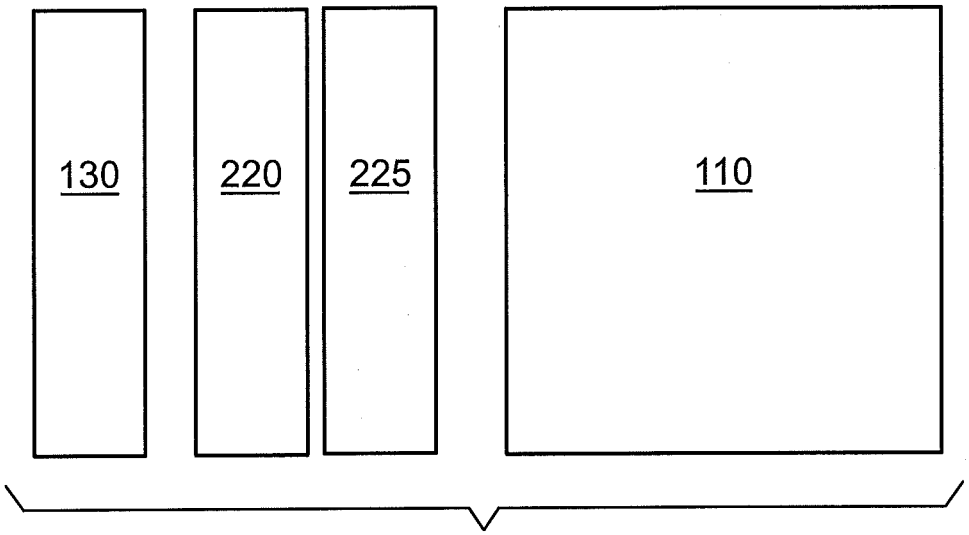
FIG. 5 illustrates a magnified cross-sectional view of an embodiment of a pouched non-tobacco product including a multilayered liner.

For example, as illustrated in FIG. 5, a liner can be provided as two layers, i.e., an outer liner 220 and an inner liner 225, between a non-tobacco flavorful material 110 and a web 130. The outer liner 220 (adjacent the web 130) can be provided with an immediate initial taste perception (i.e., a high water solubility level), while the inner liner 225 (adjacent the non-tobacco flavorful material 110) can be formulated to be moisture resistant (i.e., have a lower water solubility level than the outer liner 220).

The outer liner 220 can include highly water-soluble liners such that saliva can dissolve the outer liner 220 similar to the exemplary single liners 120 as mentioned above. As such, examples of the outer liner include polysaccharides, such as pectin.

The inner liner 225, on the other hand, can include moisture resistant material that can be both permeable to water and/or air, as well as water-insoluble so that moisture resistance can be maintained even during use. Examples of materials that can be used for the inner liner 225 include any porous, water-insoluble webs, sheets or liners that can be made of perforated layers or loosely bound fibers or non-woven sheets of waxes, polymers, shellac, corn zein, cellulosic materials, and/or combinations thereof.

Exemplary waxes include carnauba wax, candelilla wax, rice-bran wax, and/or waxes of paraffin and/or polyethylene, wherein wax coatings can provide excellent moisture liners.

Exemplary polymers include polyvinyl acetate (PVA), and/or polysaccharides, such as caramelized sugar, which have water-insoluble, or time-release or slowly water soluble properties (i.e., having the property of retarded or gradual dissolution in water to produce a sustained effect).

By using a combination of liners, the moisture content of the non-tobacco flavorful material itself can be controlled by the inner liner resisting release of the moisture from the non-tobacco flavorful material 110, while flavor can be released from the outer liner 220. Additionally, the inner liner 225 can also be dissolvable and flavored, such that a two-stage flavor release can be provided, wherein the outer liner 220 can release flavor as a first stage before the inner liner 225 dissolves, which in turn releases a second stage of flavor, thus a two-stage flavor release can be attained if desired.

The liner can be disposed along the web by any suitable technique. For example, a strip of liner material can be fed along with a strip of web material and the strips can optionally be engaged with each other by pressing the strips together, use of adhesive or tackiness of the liner material. Alternatively the liner material can be coated on the web. In the case of multiple coatings, each coating, which may be the same or different liner, of a multilayered liner is preferably dried before application of subsequent coatings. For example, multiple coatings (e.g., 5 coatings) may be applied by gravure printing (see further description, below) to provide a total coating weight effective to achieve non-staining and/or flavor delivery goals such as 10 to 200 mg, 20 to 100 mg, for example, 45 mg/pouched non-tobacco product. Each coating layer is preferably dried before application of a subsequent coating layer. In order to add flexibility and maintain and protect moisture levels in the pouched non-tobacco product, one or more humectants, such as, for example, propylene glycol, can be incorporated into the coated web liner material.

Preferably, drying of a coated liner is performed by gentle drying, for example, air drying at a low temperature (e.g., slightly above ambient, preferably up to about 150° F., more preferably 100-150° F.) and at a lower speed and longer resident time than would be used with higher temperature drying (e.g., 300-350° F.).

In another embodiment, flavor compounds can be incorporated into the non-tobacco flavorful material 110 and/or the web material 130, as well as the liner 120 to insure a consistent flavor release. For example, a non-tobacco flavorful material with menthol flavoring therein can be incorporated into a pouched non-tobacco product 100 with additional non-tobacco flavoring in the liner 120 for a stronger non-tobacco flavor in combination with a menthol flavor.

In another embodiment, the moisture resistance (i.e., the water solubility) of the liner 120 can be adjusted as a function of the moisture content of the non-tobacco flavorful material 110 in order to provide a desired moisture level in the pouched non-tobacco product 100. For example, the liner 120 can include humectants to allow a non-tobacco flavorful material in a pouched non-tobacco product to maintain a predetermined moisture content of the non-tobacco flavorful material between about 5% to about 65%.

In another embodiment, the water activity of the component(s) of the non-tobacco flavorful material 110 can be matched, wherein the water activity ($a_w$) represents the ratio of the water vapor pressure of the component to the water vapor pressure of pure water under the same conditions and it is expressed as a fraction. Thus, by matching the water activities of the web material 130, the flavor compounds, and the non-tobacco flavorful material 110, the moisture transfer between the web material 130, flavor compounds, and the non-tobacco flavorful material 110 can be limited. Therefore, by matching or adjusting the water activities, the liner 120 can be used to provide flavor release alone, wherein staining of a web can be reduced without requiring further measure.

Exemplary liners 120 include food grade materials, such as polysaccharides including pullulan, protein films, or synthetic polymers, including those listed above. It is noted, however, that any liner that is biocompatible and reduces staining of the web can be used. Films that can be used for the liner include films manufactured by MonoSol, LLC of Portage, Ind. as set forth in International Publication Numbers WO 2004/009445 and WO 2004/052335, hereby incorporated by reference in their entireties.

In order to facilitate coating of the liner on the web, the liner may be in the form of a slurry. Alternatively or additionally, liner material (e.g., slurry of material used to form a liner) may be applied to the web during manufacture of the web. Encapsulated flavorants may be incorporated into the liner to prolong flavor release from the liner.

In an embodiment, the liner 120 is coated onto the web 130 prior to assembly of the pouched non-tobacco product 100 by a suitable coating process, such as, for example, kiss coating, slot coating, spraying or gravure printing. Coating of the liner 120 on the web material 130 allows for enhanced control and maintenance of the desired level of translucency of the web. Alternatively, the color of the pouched non-tobacco product may be controlled by inclusion of appropriate color additives into the liner 120 such as whiteners or the like. Thus, through appropriate selection of additives for the liner 120, the opaqueness, whiteness, and/or color of the pouched non-tobacco product may be controlled.

Kiss coating involves applying a coating to a surface using rotating rollers. Fluid flow in a nip between adjacent rollers and the relative speeds of the rollers control the coating thickness. In reverse-roll coating, an applicator roller preferably rotates against a ribbon of web 130 and a slurry of liner material is preferably established at the nip between the two rollers.

Slot coating can be used with slurries having a wide range of viscosities. In slot coating, slurry of liner material is directed through a slot die to provide a single layer application to a ribbon of the web 130 moving relative to the die. Slurry of liner material is fed into the die by a metering device such as, for example, a positive displacement pump. Coating thickness is dependent on speed of the web and flow rate of the slurry.

Gravure printing gives thin, accurate coatings and is capable of high speed application. In gravure printing, a roller with an engraved pattern rotates in a reservoir containing slurry of liner material. Slurry of liner material is collected in the engraved pattern and excess surface slurry of liner material is removed from the roller by a doctor blade. Slurry of liner material is transferred from the roller onto the ribbon of web 130.

The liner 120 may comprise optional components including, but not limited to, additional flavorants, sweeteners, fragrances, coloring agents, filling agents, thickening agents, plasticizers, surfactants, stabilizing agents, antioxidants, preservatives, brighteners and the like.

Exemplary additional natural and artificial flavorants include, but are not limited to, peppermint, spearmint, wintergreen, menthol, cinnamon, chocolate, vanillin, licorice, clove, anise, sandalwood, geranium, rose oil, vanilla, lemon oil, cassia, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, orange oil, coriander oil, borneol, fruit extract, and the like. Particularly preferred additional flavor and aroma agents are essential oils and/or essences of coffee, tea, cacao, and mint.

The liner 120 may optionally comprise both natural and artificial sweeteners. Preferred sweeteners include water soluble sweeteners such as monosaccharides, disaccharides and polysaccharides (e.g., xylose, ribose, sucrose, maltose, fructose, glucose, maltose, mannose). In addition, or in the alternative to sweeteners, the liner 120 may comprise souring agents such as acetic acid, adipic acid, citric acid, lactic acid, malic acid, succinic acid, tartaric acid, and mixtures thereof. The liner 120 may also include pigments (e.g., coloring agents).

Filling agents may be incorporated in the liner 120. Exemplary filling agents include, but are not limited to, cellulose, titanium oxide, magnesium silicate (e.g., talc), aluminum silicate, magnesium carbonate, calcium carbonate (e.g., limestone), calcium phosphate, calcium sulfate, zinc oxide, aluminum oxide, and mixtures thereof. Other carbonate and phosphate salts can be added.

Starches and/or cellulose ethers can also be incorporated in the liner 120, wherein the starches and/or cellulose ethers can act as thickening agents or binding agents. Additionally, polymers, such as polyvinyl pyrrolidone and polyvinyl alcohol, and gums, such as xanthan gum, gum Arabic and acacia gum, can be used as thickening agents. Generally, the stiffness of a liner 120 can be increased and the dissolution rate (i.e., dissolution upon exposure to moisture) can be decreased by increasing the average molecular weight of polymers that form the liner 120. Thus, by adding thickening agents the modulus (i.e., stiffness) of the liner 120 can be increased, while the propensity toward curling or bending of a liner 120 during or after drying (e.g., during storage) can be decreased.

Plasticizing agents can also be used to control the stiffness of the liner 120, as well as the viscosity of the polymer melt from which a liner 120 is formed. Exemplary plasticizing agents include monoacetin; diacetin; triacetin; glycols, such as polyethylene glycol and propylene glycol; polyhydric alcohols, such as glycerin and sorbitol; mineral oils; vegetable oils; and glycerol and glycerol esters, such as glycerol triacetate.

Surfactants can also be incorporated in the liner 120. Suitable surfactants include, but are not limited to, mono and diglycerides of fatty acids, lactylates, pluronic acid, polyoxyethylene sorbitol esters, latanol, and sodium lauryl sulfate.

Stabilizing agents can also be incorporated in the liner 120. Exemplary stabilizing agents are gums, such as guar gum, xanthan gum, locust bean gum, and carrageenan.

Exemplary liners 120 can also optionally comprise antioxidants and/or preservatives. Exemplary antioxidants include, but are not limited to, ascorbic acid, vitamin E and sodium pyrosulfate. Exemplary preservatives include, but are not limited to, acetic acid, benzoic acid, citric acid, lactic acid, malic acid, sorbic acid and tartaric acid.

The liners 120 can be translucent or substantially opaque.

4. Product Components and Manufacture of Product

Referring to FIG. 6*a*, a liner 61 (an equivalent to liner 120) can be continuously applied to a ribbon of web 120. The liner 61 is preferably centered on the web 60, leaving longitudinal edge portions 62, 62' essentially free of liner.

FIG. 7*a* illustrates an embodiment wherein a liner 71 (an equivalent to liner 120) has been intermittently applied to a web. Intermittent application of liner at spaced apart regions 71, 71', 71" along the web establish longitudinal edge portions 62, 62' and transverse zones 79 along the web that are essentially free of liner 71. Referring now also to FIG. 2, the longitudinal edge portions 62, 62' and transverse zones 79 are used to form the sealed seams 74, 75 and 75' of the product 100. The arrangement avoids sealing of a region that contains liner material so as to minimize impact on taste on the liner from sealing operations and to enhance integrity of the seal.

Sealing may be accomplished by any suitable sealing method, such as, for example, adhesive or by mutual sealing. Mutual sealing may be thermal or sonic. Preferably, sealing is accomplished by thermal sealing. In particular, the thermal sealing may be accomplished using an arcuate iron (heater), such as a heated disc. An arcuate iron would engage one side of the web, which preferably contains polypropylene, for example, in the form of polypropylene fibers or a polypropylene film, and press the first side of the web against the second side of the web, and against a second, opposed iron or non-heated surface.

FIG. 6*a* shows web 60 on which liner 61 has been coated, printed, bonded, calendared, laminated, placed, or otherwise established prior to or while being folded into a pouch 100. In particular, web 60 may be, for example, about 31 mm wide, while liner 61 may be, for example, about 25 mm wide, leaving about 3 mm of web 60 essentially free of liner 61 along each longitudinal edge portions 62, 62' of web 60. Referring now also to FIG. 6*b*, the web 60 and liner 61 are folded into a tubular formation 63 with the liner 61 on the inside. In so doing, the longitudinal edge portions 62, 62' are brought into an overlapping, web-to-web relation and sealed to form the longitudinal seam 74, which is preferably about 3 mm wide in the exemplary embodiment. The longitudinal seam 74 is essentially free of liner material so that the seal is steadfast. Such arrangement also minimizes heating of liner material during sealing operations along the longitudinal seam 74 so that impact on taste of the product during formation of the longitudinal seam 74 is minimized. A packet of pouched non-tobacco 100 is achieved by introduction of non-tobacco 110 into the tubular form 63, and also sealing and cutting the tubular formation 63 at locations A and B, as described in further detail below.

Alternatively, FIG. 7*a* shows web 70 on which liner has been coated, printed, bonded, calendared, laminated, placed, or otherwise established in multiple regions 71, 71', 71". The regions 71, 71', and 71" are spaced from one another so as to establish transverse zones 79 at spaced locations along the web 70 which are essentially free of liner material. Transverse zone 79, may be, for example, about 7 mm wide. Preferably, the liner regions 71, 71', 71" are spaced from longitudinal edges of the web 70 so as to establish longitudinal edge portions 62, 62'. The web 70 on which the liner regions 71, 71', 71" has been established is folded into a tubular formation 73. The overlapping longitudinal edge portions 62, 62' are sealed to form a longitudinal seal 74 that is essentially free of liner as in the other embodiment shown in FIG. 6*b*, allowing the edge portions 62, 62' to be bound together in a web to web contact or relation to one another. Likewise, sealing and severing operations are undertaken along transverse zones 79 so that transverse seams 75,75' are formed from web portions that are brought into web to web relation with one another and are essentially free of liner material.

The pouched non-tobacco product 100 may be made using any suitable equipment, such as, for example, a Poucher Machine sourced from Merz Verpackungsmaschinen GmbH, Lich, Germany. With reference to FIG. 8, in operation, ribbons of web 70 and liner film 81 from which disposable backing 103 has been removed are both drawn from separate bobbins 82, 83, respectively, toward a forming shoulder 84, which folds the web 70 and liner film 81 about the feed tube 85, forming a lined pouch material which is similar to the lined pouch material shown in FIG. 6*a*. The liner-free edge portions 62, 62' are brought into overlapping relation and the tubular formation 73 is established (which is similar to the formation 63 shown in FIG. 6*b*). A heated knurled disc 86 then seals the overlapping liner-free, longitudinal edge portions 62, 62' of the web 70 by pressing and heating the seam as the web 70 is drawn along feed tube 85.

Drive belts or drive wheels 87 located below forming shoulder 84 continuously pull web 70 through forming shoulder (folder) 84 and beyond. An upper pair of opposing heat-sealing elements 88, and a lower pair of heat-sealing elements 89 cooperate with a knife 90 to repetitively seal and sever. Discrete charges of non-tobacco flavorful material 91 are fed through feed tube 85 in timing with operation of sealing elements 88, 89. The transverse sealing elements 88, 89 and knife 90 arrangement follow a motion cycle where sealing elements 88, 89 close together, whereupon non-tobacco flavorful material is fed into the feed tube 85. They then move down together in opposing relation with each other to a final lowered position whereupon the knife 90 operates to sever the web. The sealing elements 88, 89 then retract and return to original starting position further up the feed tube 85.

After insertion of a portion of non-tobacco flavorful material 110 into the tubular formation 73, sealing and severing operations form seams 75, 75' at a location corresponding to the area A shown in FIG. 6*b* to close a filled pouch 100 and preferably to form the bottom seal of the next pouch to be filled. After severing in the area of the seams 75, 75', a filled pouch is closed at its upper transverse seam 75, which may be, for example, about 3.5 mm wide. Severing in the area of the seals 75, 75' thus separates the top transverse seam 75 of a filled pouch 100 from the bottom seam 75' of the next pouch to be filled.

Alternatively, a laminate of web and film liner are drawn from a single bobbin to the forming shoulder (folder) 84 of the previously described equipment. Referring now also to FIGS. 7*a* and 7*b*, alternatively, a web 70 having multiple spaced-apart zones 71, 71', 71" is fed from a single bobbin and the sealing elements 88, 89 and the knife 90 are synchronized to operate synchronously with arrivals of transverse zones 79.

Accordingly, transverse seams 75, 75' are established where the web 70 is overlapped in a web-to-web relation and sealed at the liner-free transverse zones 79. The transverse seams 75, 75' are essentially free of liner material so that the seal is steadfast. Such arrangement also minimizes heating of liner material during sealing operations along the transverse seams 75, 75' so that impact on taste of product due to sealing operations is further minimized.

With regard to the supply of non-tobacco flavorful material into the feed tube, metered portions of non-tobacco flavorful material is blown via air into the feed tube 85 after the upper sealing elements 88, 89 have been closed upon the tubular formation 73. Optionally, the longitudinal seam 74 is made narrower then the width of the overlapping, longitudinal edge portions 62, 62' along the tubular formation 73. In so doing, liner free web material remains in an unsealed condition along the seam 74, and as such is air permeable. The air permeable web portions along the longitudinal seam 74 allow air to pass through the permeable web and thus avoid blow-back of non-tobacco flavorful material during non-tobacco flavorful material feeding operations into the feed tube 85.

Likewise, optionally, the transverse seam 75' formed by the upper sealing elements 88 maybe made narrower than the width of liner free material available thereat (i.e., the seam 75' is made narrower than the half-width of the transverse zone 79 adjacent the upper sealing elements 88), so that some liner free portion of the transverse zone 79, which is air permeable, remains in an unsealed condition adjacent the transverse seam 75'. In this fashion there is established one or more air permeable web portions along the seams 75'.

In effect, the overlapping liner free material along the seams 74 and/or 75' is optionally greater than the width of the sealed regions establishing the seams 74 and/or 75' so that along those seams some liner-free material remains in an unsealed condition and is therefore air-permeable. Optionally, one or more of the seams 74, 75 and 75' include at least one air permeable portion.

The air permeable portions along the seams 74 and/or 75' and/or the transverse zones 79 themselves allow air to pass through the porous web and thus avoid blowback of non-tobacco flavorful material during non-tobacco flavorful material feeding operations into the feed tube 85.

In an embodiment, a web may be combined with flavor strip material to produce a laminated lined pouch material, which is described with reference to FIG. 9. A roll of flavor strip material 90 with backing material 91 is put onto an upper bobbin carrier 92, while a roll of web 93 is put onto the lower bobbin carrier 94. The web 93 is fed through the machine, which includes embossing rollers 95, having an embossing pattern as indicated in insert 96. Preferably, the embossing rollers include heated rollers such as those obtainable from Boegli Gravures S.A., Marin Switzerland. The flavor strip material 90 is peeled away from the backing material 91 and fed through the machine. The backing material 91 is collected at a core 97 on a rewind station for the backing material. The embossing rollers 95 slowly engage until pressure fuses or calendars the flavor strip material 90 and web 93 together to form a laminated (integrated) lined pouch material, which is collected on a core 98 at a rewind station to form bobbins of lined pouch material. The machine includes five servo drives—the flavor strip with backing unwind 92, the infeed web unwind 94, the embossing rollers 95, the flavor strip backing rewind 97, and the lined pouch material rewind 98. An optional laser 99 can burn a pattern through the flavor strip material, which may provide a channel for air stream relief, which is desirable on the pouch forming machine because air is used to convey the non-tobacco flavorful component into pouches being formed in the pouch making process, as described above. Further, the laser can burn an image such as a word or letter into the flavor strip material, and once pouches are formed, the image could become visible due to the contrasting color of the non-tobacco flavorful material behind the flavor strip material.

Contemplated alternative constructions include liners that are water-insoluble, insoluble to humectants and/or insoluble to flavorants, and liners that may be incorporated as a separate sheet, layer or coating on an outer portion of the web. Furthermore, although heat-sealing of the web along seams 74 and 75, 75' is preferred, sealing may be effected with adhesives and other expedients.

While apparatus for manufacturing pouched non-tobacco products has been described above, other apparatus can be used such as KDF machinery available from Hauni Manufacturing, Hamburg, Germany, whereby instead of using a forming shoulder as described above, a garniture can be used to fold a continuous strip of web material into a tubular form which is heat sealed and filled with non-tobacco flavorful material to form individual non-tobacco pouched products 100. See also U.S. Pat. No. 4,703,765 the disclosure of which is hereby incorporated by reference, for details of other machinery which can be adapted to manufacture lined pouches as described herein.

Variations and modifications of the foregoing will be apparent to those skilled in the art. Such variations and modifications are to be considered within the purview and scope of the claims appended hereto.

What is claimed is:

1. A method of making a pouched non-tobacco product, comprising:

disposing a liner along an outer web; and enclosing a non-tobacco flavorful component with the outer web and liner such that the liner is interposed between the non-tobacco flavorful component and the outer web wherein the disposing of the liner along the outer web comprises feeding a strip of liner material along a feed path so as to dispose the liner on the outer web.

2. The method according to claim 1, wherein forming a pouched non-tobacco flavorful product comprises sealing overlapping portions of the outer web that are essentially free of said liner so as to achieve seams with a web-to-web relation so as to form pouches sized to fit comfortably in a human oral cavity.

3. The method according to claim 2, wherein longitudinal overlapping portions of the outer web are sealed.

4. The method according to claim 2, wherein transverse overlapping portions of the outer web are sealed.

5. The method according to claim 1, wherein the pouched non-tobacco product is hermetically sealed in a package.

6. The method according to claim 1, wherein said pouched non-tobacco product comprises a transverse seam and a longitudinal seam, said longitudinal seam essentially free of said liner, said longitudinal seam constructed from overlapping longitudinal edge portions of said outer web, which are essentially in web-to-web relation with one another.

7. The method according to claim 1, wherein said pouched non-tobacco product comprises at least one transverse seam essentially free of said liner, said at least one transverse seam constructed from overlapping transverse portions of said outer web, which are essentially in web-to-web relation with one another.

8. The method according to claim 6, wherein said pouched non-tobacco product comprises at least one transverse seam essentially free of said liner, said at least one transverse seam constructed from overlapping transverse portions of said outer web, which are essentially in web-to-web relation with one another.

9. The method according to claim 6, wherein an air permeable web portion is established adjacent at least one of said seams.

10. The method according to claim 8, wherein an air permeable web portion is established adjacent at least one of said seams.

11. The method according to claim 1, wherein the liner comprises water dissolvable flavorant.

12. The method according to claim 1, wherein the liner reduces staining of the web.

13. The method according to claim 1, wherein the liner comprises a multilayer liner.

14. The method according to claim 13, wherein a first layer of the multilayer liner comprises water dissolvable flavorant, and wherein a second layer of the multilayer liner comprises a porous, moisture resistant layer.

15. The method according to claim 1, wherein the outer web comprises a porous, water-insoluble material comprised of cellulose fibers or polymers.

16. The method according to claim 1, wherein each of the non-tobacco component, the liner and the outer web have the same water activity levels.

17. The method according to claim 1, wherein the outer web has a basis weight of about 5-10, 10-15, 15-20, or 20-25 g/m2, and/or a wet tensile cross-direction (CD) strength of about 15-30, 30-45, 45-60, or 60-75 N/m.

18. The method according to claim 1, wherein the outer web has a basis weight of about 5-25 g/m2, and/or a wet tensile cross-direction (CD) strength of about N/m.

* * * * *